US009398369B2

(12) United States Patent
Yang

(10) Patent No.: US 9,398,369 B2
(45) Date of Patent: Jul. 19, 2016

(54) SPEAKER STRUCTURE

(71) Applicants: FirstChair Acoustics Co., Ltd., Taipei (TW); Ching-Wen Yang, Taipei (TW)

(72) Inventor: Ching-Wen Yang, Taipei (TW)

( * ) Notice: Subject to any disclaimer, the term of this patent is extended or adjusted under 35 U.S.C. 154(b) by 0 days.

(21) Appl. No.: 14/823,749

(22) Filed: Aug. 11, 2015

(65) Prior Publication Data

US 2015/0350757 A1 Dec. 3, 2015

Related U.S. Application Data

(63) Continuation-in-part of application No. 14/188,978, filed on Feb. 25, 2014, now abandoned.

(30) Foreign Application Priority Data

Sep. 17, 2013 (TW) ..... 102217480 U

(51) Int. Cl.
*H04R 1/28* (2006.01)
*H04R 1/02* (2006.01)
*H04R 1/24* (2006.01)

(52) U.S. Cl.
CPC ..... *H04R 1/2834* (2013.01); *H04R 1/02* (2013.01); *H04R 1/2888* (2013.01); *H04R 1/24* (2013.01); *H04R 2209/022* (2013.01)

(58) Field of Classification Search
CPC ..... H04R 1/02; H04R 1/24; H04R 1/283; H04R 1/2834
See application file for complete search history.

(56) References Cited

U.S. PATENT DOCUMENTS 7,436,972 B2 * 10/2008 Bouvier ..... H04R 1/345 381/338
2005/0195987 A1 * 9/2005 Kim ..... H04R 1/2857 381/89
2008/0169150 A1 * 7/2008 Kuo ..... H04R 1/2826 181/155
2013/0004008 A1 * 1/2013 Kuo ..... H04R 1/2834 381/349
2014/0112515 A1 * 4/2014 Gilbert ..... H04R 9/08 381/360
2015/0072723 A1 * 3/2015 Schoffmann ..... H04R 1/288 455/550.1
2015/0304760 A1 * 10/2015 Yeh ..... H04R 1/1058 381/370
2015/0350757 A1 * 12/2015 Yang ..... H04R 1/02 181/199

FOREIGN PATENT DOCUMENTS

TW M401942 4/2011

* cited by examiner

*Primary Examiner* — Matthew Eason
(74) *Attorney, Agent, or Firm* — C. G. Mersereau; Nikolai & Mersereau, P.A.

(57) ABSTRACT

The present invention provides an improved speaker structure, which includes a speaker body, a resonance body and at least one sound guiding portion. The resonance body includes a resonance film and a resonance film frame. The sound guiding portion includes a first sound guiding member, a second sound guiding member and a back frame unit. The speaker structure forms a sealed sound chamber by combining the speaker body, the resonance body and the at least one sound guiding portion. When the speaker body generates a front sound wave and a guiding sound wave, the front sound wave is transmitted within the sound chamber to the resonance film to enhance low frequency sound effect, and the guiding sound wave is transmitted within the resonance cavity and forms a back sound wave, thus reducing noise in the sound region and enabling better extension of the sound wave towards low frequency range.

17 Claims, 4 Drawing Sheets

SPEAKER STRUCTURE

CROSS REFERENCE TO RELATED PATENT APPLICATION

This patent application is a continuation-in-part (CIP) application of a U.S. patent application Ser. No. 14/188,978 filed Feb. 25, 2014, listing Ching-Wen Yang as inventor. The contents of the related patent application are incorporated herein for reference.

FIELD OF THE INVENTION

The present invention relates to an improved speaker structure, and particularly to an improved speaker structure enabling extension of the sound wave towards low frequency range and enhancing low frequency sound effect.

BACKGROUND OF THE INVENTION

An example of a conventional speaker structure has an opening in front of the shell and a magnetic circuit at the back. A sound coil is positioned at the center of the magnetic circuit. A resonance film is adhered between the opening of the shell and the sound coil. When the conventional speaker is used for a long time, the heat generated will deteriorate the adhesive. Although the conventional speaker generates sound with quality, the assembly size of the conventional speaker is large. If the speaker is used in a corresponding video displaying product, the size of the speaker must be reduced.

However, based on the design of the conventional speaker structure, there is a minimum height limitation for the speaker to provide effective resonance.

Taiwan Utility Model Patent No. M401942 discloses a speaker structure, which provides a bottom cylinder having flow guiding pieces. The flow guiding pieces are positioned at the surface of the bottom cylinder such that air flows in the video displaying product or in the speaker may flow through the air flow channels formed by the flow guiding pieces to enhance low frequency sound effect. However, the effect generated in this patent is not significant.

Based on the deficiencies of the related art, the invention provides a speaker structure, which forms the resonance film and the speaker body integrally by injection molding to solve the problem of deterioration of the adhesive due to heat generated. According to the invention, the speaker structure forms a sealed sound chamber by combining the speaker body, the resonance body and the at least one sound guiding portion. Thus, the speaker body generates a front sound wave and a guiding sound wave, structure enabling extension of the sound wave towards low frequency range and enhancing low frequency sound effect

SUMMARY OF THE INVENTION

Based on the problems as disclosed above, an objective of the present invention is to provide an improved speaker structure to solve the deficiencies of the related arts.

An aspect of the present invention provides an improved speaker structure, including a speaker body, a resonance body and at least one sound guiding portion. The speaker body includes a base, a drum paper, a yoke, a magnetic unit, a sound coil and a supporting column. The resonance body includes a resonance film and a resonance film frame, wherein one side of the resonance film is connected to the base to be surroundingly positioned around the speaker body, and the other side of the resonance film is positioned on the resonance film frame. The sound guiding portion includes a first sound guiding member, a second sound guiding member and a back frame unit, wherein the first sound guiding member has a hollow first extruding structure extruding inwards and is correspondingly positioned on the second sound guiding member, and the second sound guiding member has a hollow second extruding structure extruding outwards and correspondingly supports the first sound guiding member, wherein the first extruding structure and the second extruding structure do not contact each other, wherein the first sound guiding member and the second sound guiding member form a resonance cavity, wherein a bottom portion of the second sound guiding member is provided with an opening, and a top portion of the second sound guiding member has two sides surroundingly connected to the resonance film frame, wherein the back frame unit is connected to the opening.

A major objective of the present invention is to provide an improved speaker structure, where the speaker structure forms a sealed sound chamber by combining the speaker body, the resonance body and the at least one sound guiding portion. When the speaker body generates a front sound wave and a guiding sound wave, the front sound wave is transmitted within the sound chamber to the resonance film and drives the resonance film to generate a corresponding sound, and the guiding sound wave is transmitted within the resonance cavity and forms a back sound wave, passing through the opening and driving the back frame unit to vibrate and to generate a corresponding sound, thus generating better sound effect.

A further objective of the present invention is to provide an improved speaker structure which extends the guiding distance of the front and back sound waves, thus enabling extension of the sound wave towards low frequency range.

A further objective of the present invention is to provide an improved speaker structure, where the front and back sound waves are compressed to increase the driving forces to the resonance film and the back frame unit, thus obtaining better low frequency sound effect.

DESCRIPTION OF EMBODIMENTS OF THE INVENTION

To understand the objectives, features and effects of the present invention, the following detailed description of the embodiment of the present invention is provided along with the accompanied drawings to further describe the present invention in greater detail as follows.

Figure 1:
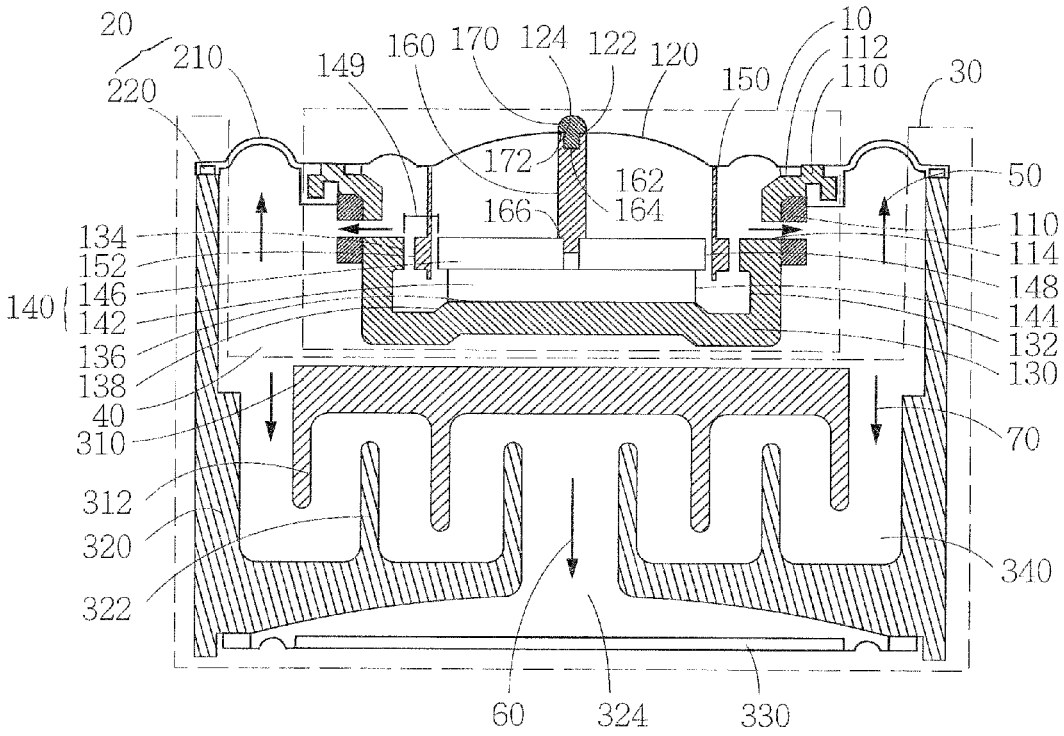
FIG. 1 is a schematic view of an improved speaker structure according to one embodiment of the present invention.

Referring now to FIG. 1, which shows a schematic view of an improved speaker structure according to one embodiment of the present invention. The improved speaker structure 1 includes a speaker body 10, a resonance body 20 and at least one sound guiding portion 30. The speaker structure 1 forms a sealed sound chamber 40 by combining the speaker body 10, the resonance body 20 and the at least one sound guiding portion 30.

The speaker body 10 includes a base 110, a drum paper 120, a yoke 130, a magnetic unit 140, a sound coil 150 and a supporting column 160. The base 110 of the speaker body 10 has an upper combining portion 112 and a lower combining portion 114; the drum paper 120 is positioned at the upper combining portion 112 and has a middle portion 122, and a center of the middle portion 122 is positioned with a through hole 124; the yoke 130 is positioned at the lower combining portion 114; the magnetic unit 140 has a magnet 142 and a front piece 146 which is magnetic permeable, and the magnetic unit 140 is positioned on the yoke 130; the sound coil 150 is surroundingly positioned at a bottom surface of the drum paper 120, and includes an electrical conductive coil 152; and the supporting column 160 has a first side surface 162 and a second side surface 166, where the first side surface 162 is positioned above the front piece 146 and has a concave 164 to support and to fix the middle portion 122 of the drum paper 120, and the second side surface 166 combines with the front piece 146. The supporting column 160 maintains the stability of the sound coil 150 in perpendicular movements, thus preventing the sound coil 150 from colliding with the yoke 130 and the magnetic unit 140. It should be appreciated that an inner ring surface 132 of the yoke 130 has a first magnetic interacting surface 134 and a second magnetic interacting surface 136. The first magnetic interacting surface 134 extends toward the front piece 146 relative to the inner ring surface 132 of the yoke 130 at a perpendicular side, and a magnetic gap 149 is formed between the first magnetic interacting surface 134 and a front piece end surface 148 of the front piece 146 for to positioning the sound coil 150. Thus, by providing electric power, the sound coil 150 generates a magnetic field, and performs perpendicular movements within the magnetic gap 149, thereby moving the drum paper 120. Due to the movement of the sound coil 150, the drum paper 120 vibrates the air and generates sound. The second magnetic interacting surface 136 extends horizontally toward two sides along a bottom of the yoke 130 to form a slot 138. The front piece end surface 148 of the front piece 146 extends outward relative to a magnet end surface 144 of the magnet 142.

It should be appreciated that the first magnetic interacting surface 134 and the front piece 146 forces the magnetic lines generated by the sound coil 150 to integrate, thus enhancing the magnetic force (Webber) within the magnetic gap 149. On the other hand, the second magnetic interacting surface 136 effectively reduces the magnetic flux (Gauss) loss during the perpendicular movements of the sound coil 150, thus preventing magnetic loss.

Further, the speaker body 10 includes a fixing column 170 and a dust cover (not shown in the figure). The fixing column 170 has a lower side surface 172. The lower side surface 172 of the fixing column 170 passes through the through hole 124 of the drum paper 120 to be fixed in the concave 164 of the supporting column 160. The dust cover is configured to be sleeve-connected to the fixing column 170 to prevent dust from entering the speaker body 10.

The resonance body 20 includes a resonance film 210 and a resonance film frame 220. One side of the resonance film 210 is connected to the base 110 to be surroundingly positioned around the speaker body 10, and the other side of the resonance film 210 is positioned on the resonance film frame 220. It should be appreciated that the resonance film 210 may be formed to have one of a continued curved structure, a wave structure and an uneven structure, and may be formed integrally with the speaker body 10. When the speaker body 10 generates a front sound wave 50, the front sound wave 50 is transmitted within the sound chamber 40 to the resonance film 210 to extend the guiding distance of the front sound wave 50, thus enabling extension of the front sound wave 50 towards low frequency range. Further, the front sound wave 50 is compressed to increase the driving force to the resonance film 210, thus enhancing low frequency sound effect. However, in another example in practice, the speaker body 10 can be replaced by choosing from one of the different types among full-range speaker body, high-pitched speaker body, and low-pitched speaker body and so on, before it is fixed on the resonance film 210 by adhesive, to achieve the performance of different sound waves and ranges.

The sound guiding portion 30 includes a first sound guiding member 310, a second sound guiding member 320 and a back frame unit 330. The first sound guiding member 310 has a hollow first extruding structure 312 extruding inwards and is correspondingly positioned on the second sound guiding member 320, and the second sound guiding member 320 has a hollow second extruding structure 322 extruding outwards and correspondingly supports the first sound guiding member 310, and the first extruding structure 312 and the second extruding structure 322 do not contact each other. The first sound guiding member 310 and the second sound guiding member 320 form a resonance cavity 340 having a speaker shape. A bottom portion of the second sound guiding member 320 is provided with an opening 324, and a top portion of the second sound guiding member 320 has two sides surroundingly connected to the resonance film frame 220. The back frame unit 330 may be a permeable or resonance material, which is connected to the opening 324, and may be formed to have one of a continued curved structure, a wave structure and an uneven structure. The first extruding structure 312 and the second extruding structure 322 could be a fin structure or a rib structure. It should be appreciated that, when the speaker body 10 generates a guiding sound wave 70, the guiding sound wave 70 is guided and transmitted within the resonance cavity 340 to reduce the standing wave of guiding sound wave 70 formed in the sound chamber 40, thus obtaining better sound tone. Further, the guiding distance of the guiding sound wave 70 may be extended to extend the guiding sound wave 70 toward low frequency range, forming a back sound wave 60. Further, the back sound wave 60 is compressed to increase the driving force to the back frame unit 33, thus obtaining better low frequency sound effect.

Figure 2:
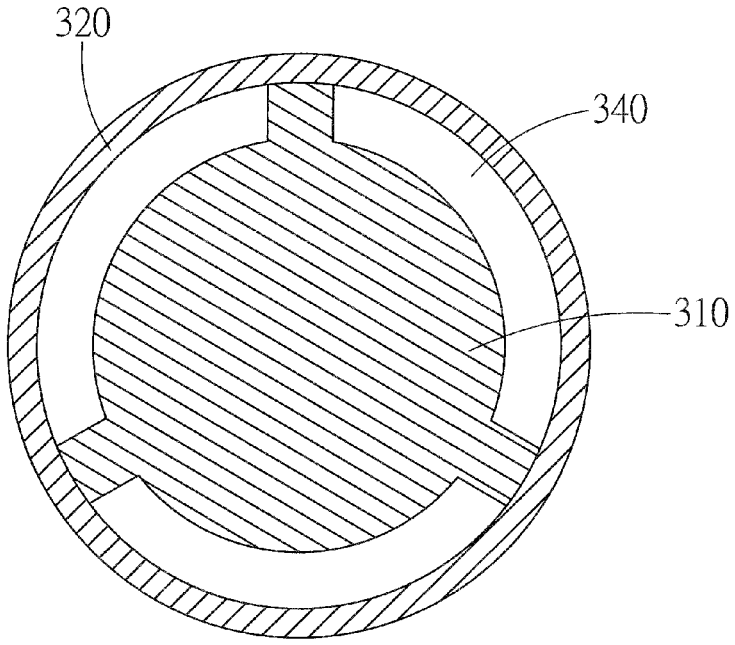
FIG. 2 is a top view of a sound guiding portion of an improved speaker structure according to one embodiment of the present invention.

Referring now to FIG. 2, which is a top view of a sound guiding portion of an improved speaker structure according to one embodiment of the present invention. The first sound guiding member 310 is positioned above the second sound guiding member 320. The second sound guiding member 320 correspondingly supports the first sound guiding member 310. The first sound guiding member 310 and the second sound guiding member 320 form the resonance cavity 340 therebetween.

Figure 3:
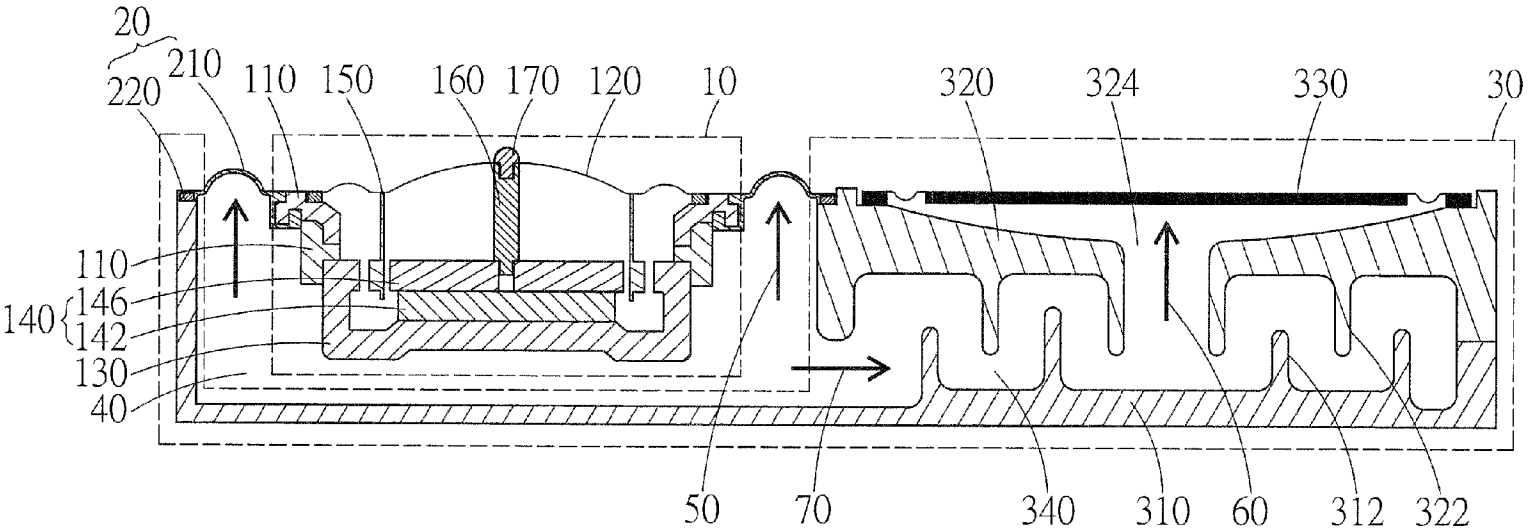
FIG. 3 is another schematic view of an improved speaker structure according to one embodiment of the present invention.

Referring to FIG. 3, which is another schematic view of an improved speaker structure according to one embodiment of the present invention. In this figure, the structures, positioning and actions of the speaker body 10 and the resonance body 20 are the same as those as shown in FIG. 1, and is hereinafter not repeated. The difference of the instant embodiment from the embodiment as shown in FIG. 1 exists in the positioning of the sound guiding portion 30 along the perpendicular direction. One end of the first sound guiding member 310 is connected to one end of the resonance film frame 220, and the other end of the first sound guiding member 310 extends horizontally toward two sides along a bottom of the speaker body 10, and is connected to one end of the bottom portion of the second sound guiding member 320. The other end of the second sound guiding member 320 is connected to another end of the resonance film frame 220. The first sound guiding member 310 has a hollow first extruding structure 312 extruding inwards and correspondingly positioned to support the second sound guiding member 320, and the second sound guiding member 320 has a hollow second extruding structure 322 extruding outwards and is correspondingly positioned above the first sound guiding member 310. The first extruding structure 312 and the second extruding structure 322 do not contact each other, and the first sound guiding member 310 and the second sound guiding member 320 form a resonance cavity 340. A top portion of the second sound guiding member 320 is provided with an opening 324, and the back frame unit 330 is connected to the opening 324. It should be appreciated that, when the speaker body 10 generates a guiding sound wave 70, the guiding sound wave 70 is guided and transmitted within the resonance cavity 340 to reduce the standing wave of guiding sound wave 70 formed in the sound chamber 40, thus obtaining better sound tone. Further, the guiding distance of the guiding sound wave 70 may be extended to extend the guiding sound wave 70 toward low frequency range, forming a back sound wave 60. Further, the back sound wave 60 is compressed to increase the driving force to the back frame unit 330, thus obtaining better low frequency sound effect.

Figure 4:
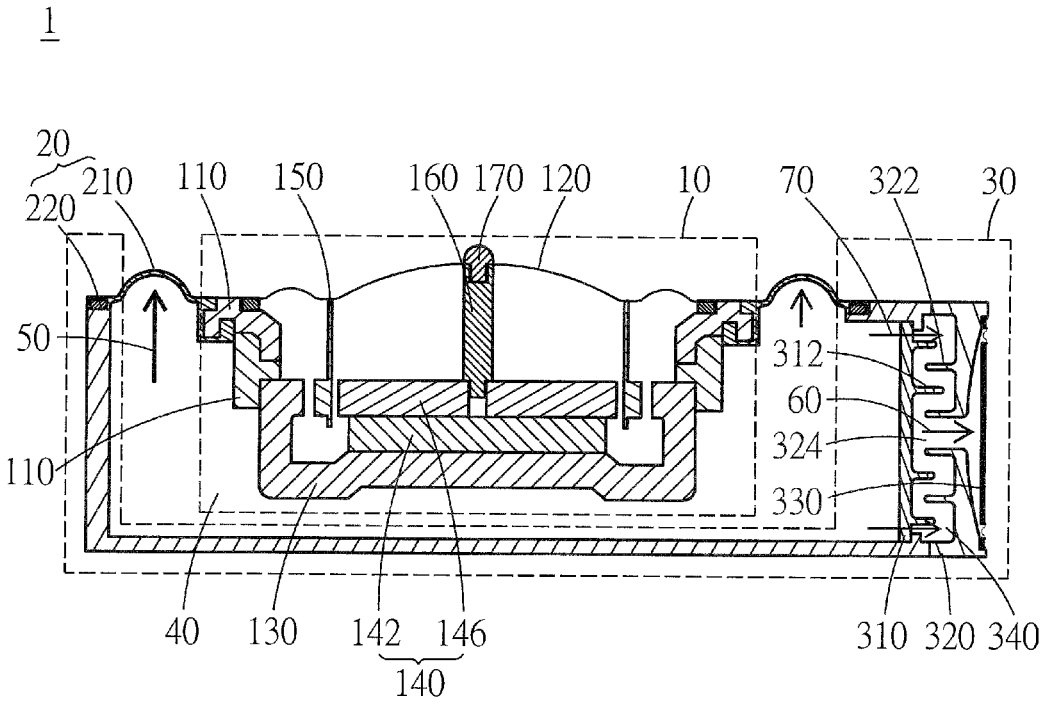
FIG. 4 is a further schematic view of an improved speaker structure according to one embodiment of the present invention.

Referring to FIG. 4, which is a further schematic view of an improved speaker structure according to one embodiment of the present invention. In this figure, the structures, positioning and actions of the speaker body 10 and the resonance body 20 and the structure of the sound guiding portion 30 are the same as those as shown in FIG. 1, and is hereinafter not repeated. The difference of the instant embodiment from the embodiment as shown in FIG. 1 exists in that the sound guiding portion 30 as shown in FIG. 1 is positioned surrounding the bottom of the speaker body 10 in a perpendicular distribution, and the sound guiding portion 30 as shown in FIG. 4 is positioned surrounding the bottom of the speaker body 10 in a horizontal distribution. The first sound guiding member 310 has a hollow first extruding structure 312 extruding away from the speaker body 10 in the horizontal direction and correspondingly positioned at a side of the second sound guiding member 320 near the speaker body 10, and the second sound guiding member 320 has a hollow second extruding structure 322 extruding towards the speaker body 10 in the horizontal direction and is correspondingly positioned at a side of the first sound guiding member 310 away from the speaker body 10. The first extruding structure 312 and the second extruding structure 322 do not contact each other, and the first sound guiding member 310 and the second sound guiding member 320 form a resonance cavity 340. A bottom portion of the second sound guiding member 320 is provided with an opening 324, and a top portion of the second sound guiding member 320 has two sides surroundingly connected to the resonance film frame 220. The back frame unit 330 is connected to the opening 324. It should be appreciated that, when the speaker body 10 generates a guiding sound wave 70, the guiding sound wave 70 is guided and transmitted within the resonance cavity 340 to reduce the standing wave of guiding sound wave 70 formed in the sound chamber 40, thus obtaining better sound tone. Further, the guiding distance of the guiding sound wave 70 may be extended to extend the guiding sound wave 70 toward low frequency range, forming a back sound wave 60. Further, the back sound wave 60 is compressed to increase the driving force to the back frame unit 330, thus obtaining better low frequency sound effect.

The abovementioned embodiments are provided to illustrate the principles and exemplary methods of manufacturing or formation method of the present invention only. The scope of the present invention shall be defined by the claims recited hereafter, and any modifications or variations to the terms or wordings recited in the claims shall be considered as their relevant equivalence and are within the scope of the present invention. The scope of the present invention shall be determined by the content of the claims recited hereafter.

What is claimed is:

1. An improved speaker structure, comprising:

a speaker body, comprising a base, a drum paper, a yoke, a magnetic unit, a sound coil and a supporting column;

a resonance body, comprising a resonance film and a resonance film frame, wherein one side of the resonance film is connected to the base to be surroundingly positioned around the speaker body, and the other side of the resonance film is positioned on the resonance film frame; and at least one sound guiding portion, comprising a first sound guiding member, a second sound guiding member and a back frame unit, wherein the first sound guiding member has a hollow first extruding structure extruding inwards and is correspondingly positioned on the second sound guiding member, and the second sound guiding member has a hollow second extruding structure extruding outwards and correspondingly supports the first sound guiding member, wherein the first extruding structure and the second extruding structure do not contact each other, wherein the first sound guiding member and the second sound guiding member form a resonance cavity, wherein a bottom portion of the second sound guiding member is provided with an opening, and a top portion of the second sound guiding member has two sides surroundingly connected to the resonance film frame, wherein the back frame unit is connected to the opening;

wherein the speaker structure forms a sealed sound chamber by combining the speaker body, the resonance body and the at least one sound guiding portion; wherein a front sound wave and a guiding sound wave are generated by a resonance formed by the yoke of the speaker body and the first and second sound guiding members of the at least one sound guiding portion such that when the front sound wave and the guiding sound wave are generated from the speaker body, the front sound wave is transmitted within the sound chamber to the resonance film and drives the resonance film to generate a corresponding sound, and the guiding sound wave is transmitted within the resonance cavity and forms a back sound wave, passing through the opening and driving the back frame unit to vibrate and to generate a corresponding sound.

2. The improved speaker structure as claimed in claim 1, wherein the base of the speaker body has an upper combining portion and a lower combining portion; the drum paper is positioned at the upper combining portion and has a middle portion, wherein a center of the middle portion is positioned with a through hole; the magnetic unit has a magnet and a front piece, wherein the magnetic unit is positioned on the yoke; the yoke is positioned at the lower combining portion; the sound coil is surroundingly positioned at a bottom surface of the drum paper; and the supporting column has a first side surface and a second side surface, wherein the first side surface is positioned above the front piece and has a concave to support and to fix the middle portion of the drum paper, and the second side surface combines with the front piece.

3. The improved speaker structure as claimed in claim 2, wherein an inner ring surface of the yoke has a first magnetic interacting surface and a second magnetic interacting surface, wherein the first magnetic interacting surface extends toward the front piece relative to the inner ring surface of the yoke at a perpendicular side, and the second magnetic interacting surface extends horizontally toward two sides along a bottom of the yoke to form a slot.

4. The improved speaker structure as claimed in claim 3, wherein a front piece end surface of the front piece extends outward relative to a magnet end surface of the magnet.

5. The improved speaker structure as claimed in claim 4, wherein a magnetic gap is formed between the first magnetic interacting surface and the front piece end surface of the front piece.

6. The improved speaker structure as claimed in claim 5, wherein the magnetic gap is configured to position the sound coil.

7. The improved speaker structure as claimed in claim 5, wherein the front piece is magnetic permeable.

8. The improved speaker structure as claimed in claim 6, wherein the sound coil further comprises an electrical conductive coil.

9. The improved speaker structure as claimed in claim 2, wherein the speaker body further comprises a fixing column, the fixing column having a lower side surface, wherein the lower side surface of the fixing column passes through the through hole of the drum paper to be fixed in the concave of the supporting column.

10. The improved speaker structure as claimed in claim 9, wherein the speaker body further comprises a dust cover configured to be sleeve-connected to the fixing column.

11. The improved speaker structure as claimed in claim 1, wherein the resonance film is formed to have one of a continued curved structure, a wave structure and an uneven structure.

12. The improved speaker structure as claimed in claim 11, wherein the resonance film is formed integrally with the speaker body.

13. The improved speaker structure as claimed in claim 1, wherein the extruding structure is a fin structure or a rib structure.

14. The improved speaker structure as claimed in claim 1, wherein the back frame unit is formed to have one of a continued curved structure, a wave structure and an uneven structure.

15. The improved speaker structure as claimed in claim 14, wherein the back frame unit is a permeable or resonance material.

16. The improved speaker structure as claimed in claim 7, wherein the resonance cavity is connected to the opening.

17. The improved speaker structure as claimed in claim 9, wherein the resonance cavity is formed to have a speaker shape.

* * * * *